US006116467A

United States Patent [19]

Petriekis et al.

[11] Patent Number: 6,116,467

[45] Date of Patent: Sep. 12, 2000

[54] BEVERAGE DISPENSING SYSTEM

[75] Inventors: Paul F. Petriekis, Palos Park; Michael Wilford, Downers Grove, both of Ill.

[73] Assignee: Packaging Systems, Inc., Romeoville, Ill.

[21] Appl. No.: 09/205,819

[22] Filed: Dec. 4, 1998

[51] Int. Cl.[7] ..... B65B 1/04

[52] U.S. Cl. ..... 222/105; 141/114

[58] Field of Search ..... 222/105, 92, 107; 141/114, 98, 82

[56] References Cited

U.S. PATENT DOCUMENTS 3,096,912 7/1963 Rivette ..... 222/105
4,516,693 5/1985 Gaston ..... 222/105
5,797,524 7/1998 Lentz ..... 222/105

*Primary Examiner*—Steven O. Douglas
*Attorney, Agent, or Firm*—Wallentstein & Wagner, Ltd.

[57] ABSTRACT

A system and process for dispensing liquid beverage having a containing vessel, a pouch within a cavity of the containing vessel, a spout connected to the pouch, and a dispensing valve connected to the pouch for controlling the flow of liquid from an interior pocket of the pouch. The pouch of the system has a first panel and a second panel heat sealed together at their respective bottom and opposing side panels to form an interior pocket between the first and second panels. The interior pocket is bounded at the sides and bottom thereof, but has an open top to provide an ingress thereinto for filling the pouch. The system provides a clean and sanitary means for containing and dispensing liquid products.

21 Claims, 4 Drawing Sheets

BEVERAGE DISPENSING SYSTEM

DESCRIPTION

1. Technical Field

The present invention relates generally to collapsible pouches and, more particularly, to a liquid dispensing system utilizing a collapsible pouch.

2. Background of the Invention

Self-service dispensing containers have become very popular in restaurant settings for storing and dispensing liquid beverages. Typically, two different types of containers and systems therefor have been utilized to store and dispense the liquid product. The first of such system includes what is referred to in the art as "bag-in-box-bags." The second of such systems includes a rigid dispensing container without an internal bag. Each of these systems have their drawbacks for dispensing certain types of product.

Bag-in-box systems, and the like, utilize an enclosed bag, typically with four seals around the perimeter of the bag. Generally, the bag has a spout for filling and dispensing the product therein. Accordingly, after the sealed bag is manufactured, the end product is inserted into the bag through the spout and the spout is then sealed using a cap, valve or other sealing means. To dispense product, either a portion of the sealing means is punctured or lacerated, or the valve is manipulated to release the product. Additionally, with bag-in-box systems, evacuation channels and vacuum pump systems are often required to aid in dispensing product from within the container. As the bag-in-box bag is emptied, either with or without the aid of a vacuum pump, portions of the bag typically collapse unevenly, tending to leave pockets of product, which may become isolated from the rest of the liquid in the container. Thus, evacuation channels are required to form a conduit within the bag which cannot be closed off by the vacuum pressure on the walls of the bag. As a result of the additional elements required to drain the bag, the bag-in-box bag is expensive to manufacture, more complex, and more costly to operate. Additionally, bag-in-box bags are sold pre-filled and pre-sealed, and are disposed of when empty. Accordingly, the types of product available with bag-in-box systems is limited to product which is pre-mixed and pre-made by the beverage distributor. Fresh product, including freshly brewed iced tea is not available with bag-in-box systems.

As opposed to bag-in-box bags, rigid dispensing containers allow for preparing, storing, and dispensing freshly made product without the need for a bag. The general structure of rigid dispensing containers includes a receptacle or tank with a dispensing valve at the bottom for gravitational dispensing of product therein. Typical rigid dispensing containers include non-carbonated fountain drink dispensing containers and thermoses. Typical beverages dispensed from these containers includes water, lemonade, and other flavored powders mixed with water. These containers are generally filled, used, drained, and cleaned daily. However, the structure of the containers does not provide for easy and adequate cleaning and sanitizing, especially when certain beverage produce, such as ice tea, are stored therein. With these types of beverages, bacteria inherently begins to grow within the container after a period of time. Bacteria grows not only on the interior walls of the container, but especially within the internal components of the dispensing valve. Accordingly, when using products which promote a high growth of bacteria, these types of dispensing containers can possibly be a dangerous health hazard. Specifically, the United States Food and Drug Administration has cited thousands of food providers with health code violations due to improperly sanitized and thus "dirty" or unhealthy beverage containers.

Accordingly, a dispensing container and system in accordance with the present invention provides an inexpensive and simple solution to eliminate the drawbacks and potentially dangerous conditions inherent in the prior dispensing containers described above.

SUMMARY OF THE INVENTION

The system of the present invention is adapted for containing and dispensing liquid product from within a pouch and includes a containing vessel, a pouch, a spout, and a dispensing valve for controlling the egress of liquid from the pouch.

According to one aspect of the present invention, a disposable lining apparatus and system for brewing and/or containing and dispensing liquid beverage is disclosed. More specifically, this apparatus provides a clean and sanitary means for containing and dispensing liquid products which are inherently associated with bacteria, and the potential growth of bacteria, such as brewed ice tea. The liquid product only contacts an interior cavity of the pouch, an interior of the spout, and an interior of the dispensing tube or dispensing valve. At the end of each day, the disposable lining apparatus or pouch is removed from the containing vessel and thrown away, thereby disposing of all components which contact the liquid, and a new pouch is inserted into the containing vessel. Accordingly, bacteria cannot propagate on any of the fixed or nondisposable components. Through the use of the system of the present invention, minimal to no supplemental cleaning is required to maintain the containing vessel for such beverages completely sanitized and free of bacteria within the requirements of the United States Food and Drug Administration.

According to another aspect of the present invention, the containing vessel is provided having an interior cavity, a first opening and a second opening.

According to another aspect of the present invention, the pouch is dimensioned to fit within the interior cavity of the containing vessel. The pouch has a first panel and a second panel heat sealed together at the respective bottom and opposing sides of the panels to form an interior pocket between the first and second panels. The interior pocket is bounded by heat seals at the sides and bottom thereof, and extends substantially from an opening at the first end, or top of the pouch, to substantially the second end, or bottom of the pouch. The opening spans along substantially the entire top of the pouch, from one of the opposing sides to the other. The opening provides an ingress into the interior pocket of the pouch. A second opening in the first panel proximal the second end of the pouch provides a housing for a spout.

According to another aspect of the present invention a dispensing valve is provided for controlling the egress of liquid from the interior pocket of the pouch. In a first embodiment a first end of a dispensing tube has a fitment which is connected to the spout of the pouch, and a second end of the dispensing tube is inserted through an aperture in the dispensing valve. The dispensing valve is connected to the containing vessel at the second opening thereof. The dispensing valve has a crimping means for controlling the flow of liquid through the dispensing tube. In a second embodiment, the dispensing valve is connected to the spout of the pouch. In this embodiment the dispensing valve is dimensioned to extend through the second opening in the containing vessel and is removably secured to an outside of the containing vessel adjacent the second opening thereof.

According to another aspect of the present invention, the pouch is made of a material which allows the interior pocket of the pouch to contain liquids exceeding 150° F. without melting or breaking down. As such, not only can boiling-hot brewed tea be placed in the pouch, but tea can be brewed directly in the interior compartment of the pouch. Thus, the pouch and system for containing and dispensing liquid product of the present invention provides a system which is inexpensive, easy to use, and which overcomes all of the aforementioned inadequacies of previous containers.

Other features and advantages of the invention will be apparent from the following specification taken in conjunction with the following drawings.

BRIEF DESCRIPTION OF THE DRAWINGS

To understand the present invention, it will not be described by way of example, with reference to the accompanying drawings in which.

DETAILED DESCRIPTION OF THE PREFERRED EMBODIMENT

Figure 2:
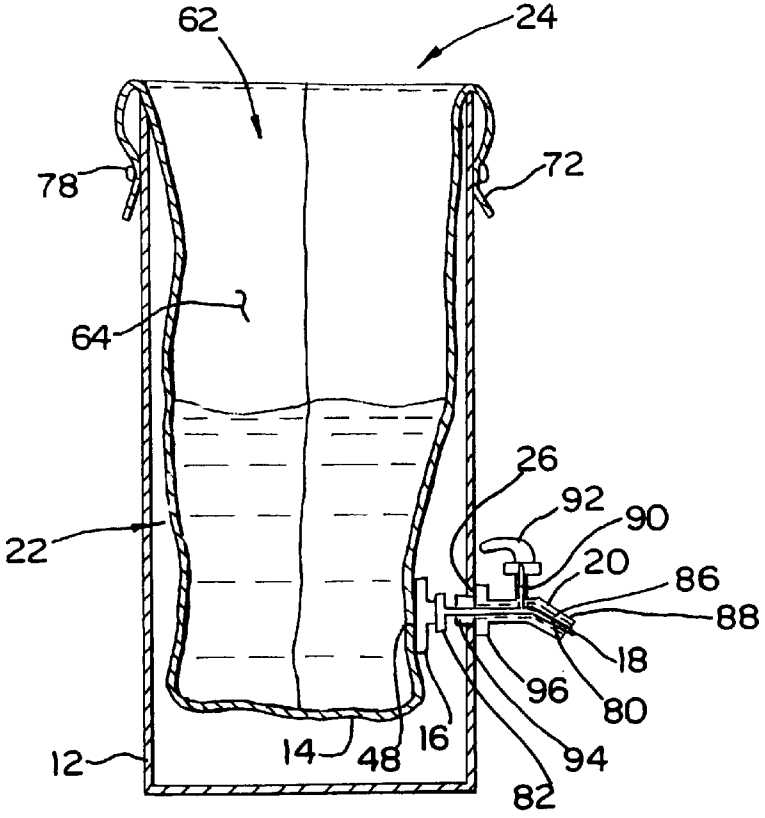
FIG. 2 is a central cross-sectional front view of the present invention of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1:
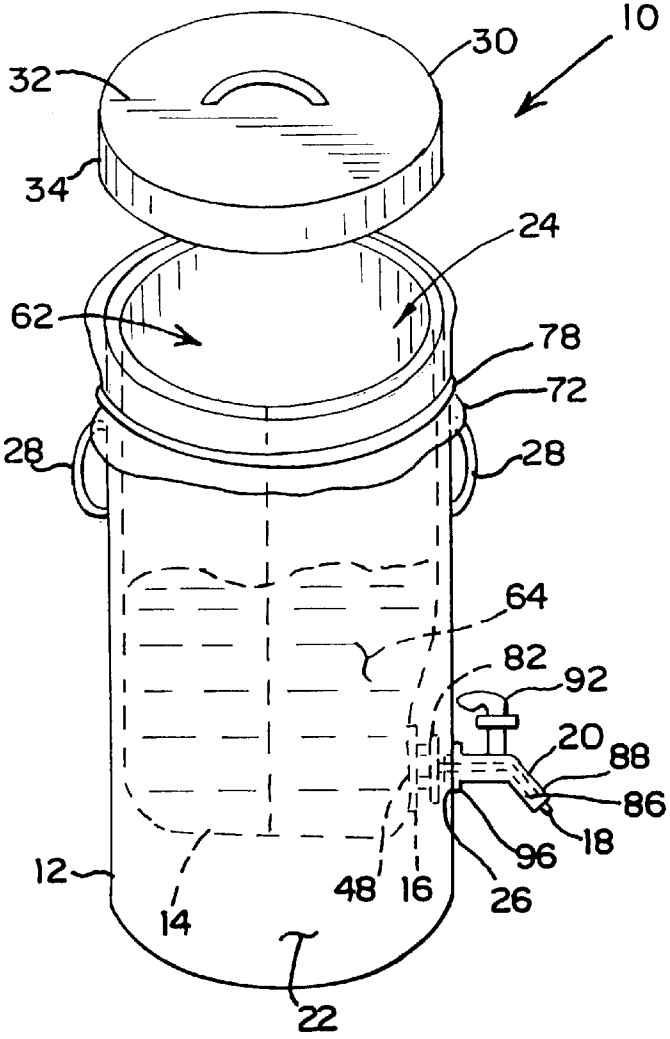
FIG. 1 is a partially exploded perspective view of a beverage dispensing system of the present invention.

Referring now in detail to the Figures, and initially to FIGS. 1 and 2, there is shown a containing and dispensing system 10 constructed in accordance with one embodiment of the present invention. The system of this embodiment generally comprises five main components: a containing vessel 12, a pouch 14, a spout 16, a dispensing tube 18, and a dispensing valve 20. The embodiment illustrate in FIGS. 1 and 2 is generally a retrofit application for a standard dispensing container. As explained supra, prior-art rigid dispensing containers (not shown) include a receptacle or tank with a dispensing valve near the bottom of the tank for controlling gravitational dispensing of liquid product therefrom. The liquid is contained directly within the tank, and is dispensed directly through the dispensing valve. As such, the liquid contacts internal components of the tank and dispensing valve. In order to properly clean the prior-art rigid dispensing containers, the tank and dispensing valve should be completely disassembled and sanitized, however, this rarely occurs. Accordingly, the embodiment shown in FIG. 1 provides a means for maintaining a sanitized and healthy rigid dispensing container, and allows for retrofitting prior art containers to provide the same.

As shown in FIGS. 1 and 2, the containing vessel 12 is generally a stainless steel or aluminum urn having an interior cavity 22, a first opening 24, and a second opening 26. While the vessel 12 is in the shape of a cylinder, it is understood that any shaped vessel (i.e., rectangular, square, conical, polygonal, circular) will provide a sufficient container for the system. Two handles 28 extend from the sides of the containing vessel 12 for lifting and transporting the vessel. Additionally, a cover 30 or top is also provided for covering the first opening 24 leading to the interior cavity 22 of the vessel. The top 30 has a flat portion 32 and a rim portion 34 extending substantially perpendicular to the flat portion. The inside diameter of the rim 34 is dimensioned such that the top 30 fits over the cylindrical vessel 12 and is adjacent the outside diameter of the vessel 12.

Figure 3A:
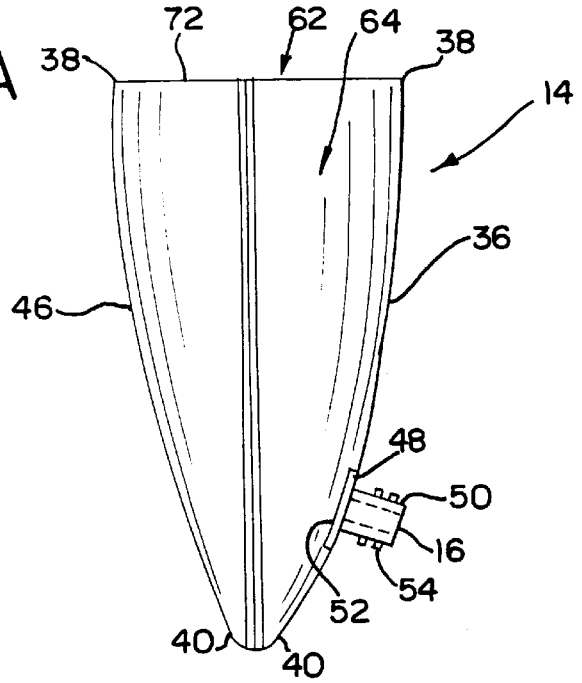
FIG. 3A is a side elevation view of a pouch of the present invention.
Figure 3B:
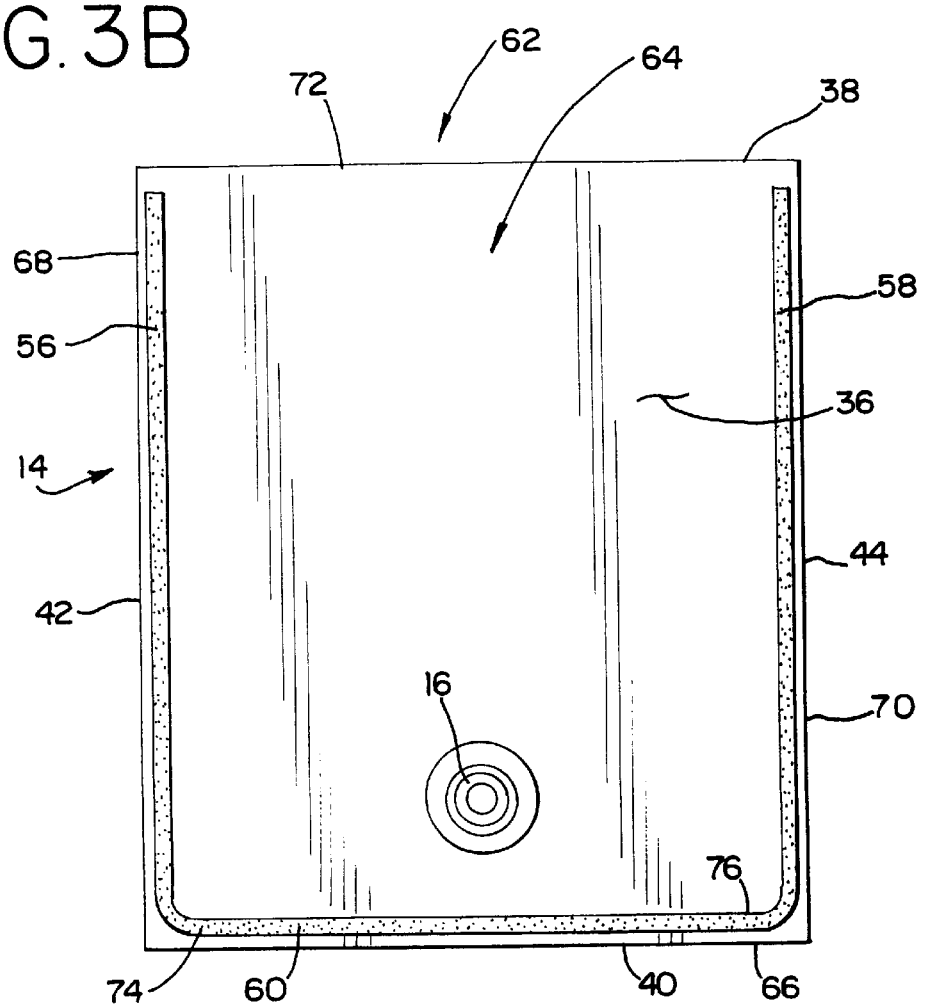
FIG. 3B is a front elevation view of the pouch of FIG. 3A.

A pouch 14 is placed through the first opening 24 of the containing vessel 12 and is dimensioned to fit within the interior cavity 22 of the containing vessel 12. As will be understood from the below disclosure, the pouch 14 forms a liner for the containing vessel 12 and dispensing valve 20 such that the liquid does not contact the internal components of either the containing vessel 12 or dispensing valve 20. With reference to FIGS. 3A and 3B, the pouch 14 generally comprises a first or frontal panel 36 having atop 38, a bottom 40, and opposing first and second sides 42,44, and a second or rearward panel 46 similarly having a top 38, a bottom 40, and opposing first and second sides 42,44. The first panel 36 has an aperture or second opening 48 extending through the panel 36 proximal the bottom 40 of the first panel. The aperture 48 serves as a housing for a spout 16 for the pouch 14. While the aperture 48 is shown centrally located between the sides 42,44 of the first panel 36, the aperture 48 may be offset to either side. Further illustrated in FIGS. 3A and 3B, the spout 16 has a cylindrical portion 50 at one end and a flange portion 52 at the other end. The cylindrical portion 50 has an opening therethrough having an inner diameter, and a longitudinal axis which extends through the center of the spout 16, from the cylindrical portion 50 through to the flanged portion 52. The cylindrical portion 50 also has ribs 54 extending from the outer diameter of the spout. The ribs 54 allow other components to be connected to the spout 16. After the aperture 48 is punched through the first panel 36, the spout 16 is positioned within the aperture 48 and the flanged portion 52 is connected to the second aperture 48 of the first panel 36 adjacent the aperture 48 by a heat seal, such that the axis of the spout 16 is substantially perpendicular to first panel 36. As is best shown in FIG. 3A, the flange 52 of the spout 16 has a first side which contacts the inner side of the first panel 36 of material. Through heat and pressure, the first panel 36 is heat sealed or welded to the flange 52 to permanently affix the spout 16 in place. The spout 16 is preferably located toward the bottom 40 of the pouch opposite the opening 62, such that when a manufactured pouch 14 is placed within the containing vessel 12, the liquid in the interior pocket 64 of the pouch will naturally feed out via gravitational forces.

In order to perform as required, the first and second panels 36,46 of the pouch are generally made of a flexible plastic material which is capable of being heat sealed together. The material utilized should have a melt softening point greater than 175° F. In the preferred embodiment, the first and second panels 36,46 are made of a linear low density polyethylene, however other materials, including polyolefin, polypropylene, polyvinyl chloride, polyester, nylon, and the like, including co-extruded and laminated materials, which exhibit similar characteristics may be used.

During manufacture of the pouch 14, the first and second panels 36,46 are heat sealed together adjacent their respective bottoms 40 and opposed first and second sides 42,44 to form a pouch 14 having three seal areas 56,58,60 and a first opening 62 to an interior pocket 64 between the connected first and second panels 36,46. When sealed together, the bottoms 40 of the panels form a sealed second end 66 of the pouch, and the opposed sides 42,44 of the panels form opposed sealed first and second sides 68,70 of the pouch 14, respectively. The tops of the panels form an open first end 72 of the pouch. Both of the opposing side seals 56,58 extend from the first end 72 of the pouch to the second end 66 of the pouch, and the bottom seal 60 extends about a length of the second end 66 of the pouch. A first end 74 of the bottom seal 60 is adjacent the first of the opposing side seals 56 and a second end 76 of the bottom seal 60 is adjacent a second of the opposing side seals 58. As such, the first opening 62 of the pouch extends horizontally from substantially the first seal area 56 to substantially the second seal area 58 adjacent the top or first end 72 of the pouch, and provides an entrance to the interior pocket 64. As seen in FIGS. 3A and 3B, the interior pocket 64 of the pouch is bounded on three sides by the three seal areas 56,58,60, and extends from the first opening 62 of the pouch adjacent the first end 72 of the pouch, to the third seal area 60 adjacent the second end or bottom 66 of the pouch. Because the pouch 14 is made of a material having a melt softening point of greater than 175° F., the interior pocket 64 of the pouch is able to contain boiling water for brewing tea. A second opening 48 to the pouch exists through the spout opening, which is proximal the second end 66 of the pouch.

Unlike other bag applications, including the bag-in-box application described supra, one end 72 of the pouch of the present invention remains open during use of the pouch. As shown in FIGS. 1 and 2, after the pouch 14 is inserted into the containing vessel 12, the first end 72 of the pouch remains substantially adjacent the first opening 24 of the containing vessel 12. Specifically, the first end 72 of the pouch is wrapped over the first opening 24 of the containing vessel such that a portion of the pouch 14 extends on the outside of the containing vessel 12. An elastic band 78 is then placed over a portion of the first end 72 of the pouch 14 that extends to the outside of the containing vessel 12 to secure the pouch 14 thereto. The first end 72 of the pouch, however, can remain removably connected adjacent the first opening 24 of the containing vessel by other means. When the pouch 14 is in this position, liquid can be inserted into the interior pocket 64 of the pouch through the first opening 24 of the vessel.

Figure 4B:
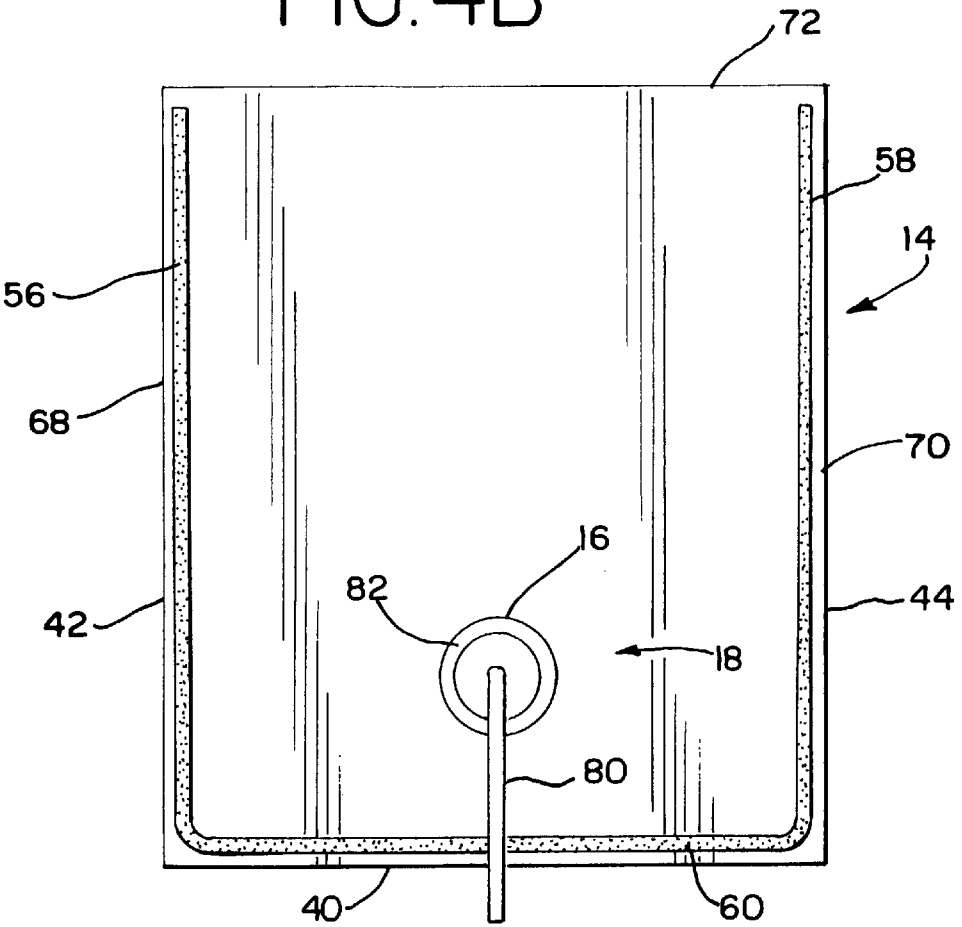
FIG. 4B is a front elevation view of the dispensing means of FIG. 4A.
Figure 4A:
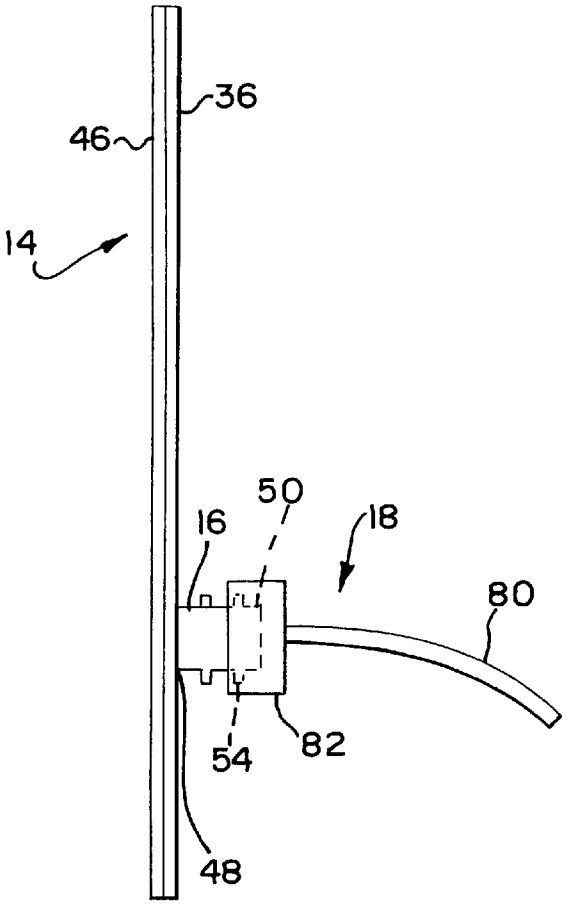
FIG. 4A is a side elevation view of one embodiment of a dispensing means of the present invention.

As shown in FIGS. 4A and 4B, in one preferred embodiment the dispenser or dispensing tube 18 is connected to the spout 16. The dispenser 18 comprises a tube 80 having a fitment 82 at one end thereof. The tube 80 is made of a flexible or elastic tubing or piping and is fixedly attached to the fitment 82. In the preferred embodiment the tube 80 is a styrene-ethylene-butene-styrene block copolymer sold by the Shell Oil Company under the trade name Kraton, the tubing having approximately an 11 mm. outside diameter, and approximately a 7 mm. inside diameter. The fitment 82 is dimensioned to fixedly attach to the cylindrical portion 50 of the spout 16 of the pouch 14 shown in FIGS. 3A and 3B. In the preferred embodiment, the fitment snaps 82 onto the ribs 54 of the spout, however, other connection means, including press fit and screw on connectors are also contemplated. As illustrated in FIGS. 1 and 2, the tube 80 is dimensioned to be inserted through an aperture or channel 86 in the dispensing valve 20.

The dispensing valve 20 is connected to the containing vessel 12 at the second opening 26 of the containing vessel as illustrated in FIGS. 1 and 2. A channel 86 extends through the body of the dispensing valve 20 to a nozzle 88 at the end of the dispensing valve 20. The channel 86 provides that the nozzle 88 is in open communication with the second opening 26, and thus the interior cavity 22, of the containing vessel 12. The dispensing valve 20 has an adjustable valve means 90 which controls the flow of liquid through the channel 86. The adjustable valve means 90 is controlled by a handle 92 at the top of the dispensing valve 20. In the preferred embodiment the valve means 90 is a protruding crimper which controls the rate of egress of liquid through the dispensing tube 18 by closing a portion of the dispensing tube 18 such that liquid cannot pass through. As will be explained infra, the dispensing tube 18 extends through the channel 86 of the dispensing valve 20. By rotating the handle 92 the valve means 90 increases or decreases the amount of liquid which is able to flow through the dispensing tube 18 thus controlling the rate of egress of liquid from within the interior pocket of the pouch. When fully engaged, the valve means 90 stops all flow of liquid through the dispensing tube 18. Generally, the end of the dispensing valve 20 opposite the nozzle 88 has a threaded portion 94 extending from a shoulder 96 of the dispensing valve 20. This threaded portion 94 extends through the second opening 26 of the containing vessel 12 and partially into the interior cavity 22 such that the shoulder 96 of the dispensing valve contacts the outside wall of the containing vessel 12 adjacent the second opening 26. A nut (not shown) within the interior cavity 22 of the containing vessel is then screwed on the threaded portion 94 of the dispensing valve 20 to fix the dispensing valve in place. As such, the dispensing valve 20 is said to be connected to the containing vessel 12 at the second opening 26 thereof. Of course, other connecting means such as snap-fit or adhesives could fix the dispensing valve to the containing vessel without departing from the scope of the invention. Additionally, the dispensing valve 20 could be integrally formed with, or manufactured as a part of the containing vessel 12.

Accordingly, one of the initial steps required to set up the system even before the pouch 14 is placed within the interior cavity 22 of the containing vessel 12 is to attach the dispensing tube 18 via the fitment 82 thereof to the spout 16. Next, if the dispensing valve 20 is not already attached to the containing vessel 12, the dispensing valve 20 must be connected at the second opening 26 of the containing vessel such that the second opening 26 and the channel 86 through the dispensing valve are in open communication. Once the dispensing valve 20 is in place, the pouch 14 is inserted into the interior cavity 22 of the containing vessel 12 and the dispensing tube 18 is extended through the second opening 26 of the containing vessel 12 and fitted into and through the channel 86 in the dispensing valve 20 such that the end of the dispensing tube 18 opposite the fitment 82 extends past or out of the nozzle 88 as shown in FIGS. 1 and 2. When liquid from within the interior pocket 64 of the pouch is expelled, it comes out of the dispensing tube 18 (which extends past the nozzle 88) and does not contact the nozzle.

Once the dispensing tube 18 is properly fitted into the dispensing valve 20, the first end 72 of the pouch 14 is located proximal the first opening 24 of the containing vessel. As shown in FIG. 1, the first end 72 of the pouch is wrapped over the first opening 24 of the containing vessel. And, a portion of the pouch 14 remains on the outside of the containing vessel 12. The elastic band 78 is then placed over the portion of the pouch 14 adjacent the outside of the containing vessel 12 to secure the pouch 14 thereto. As such, the first opening 62 of the pouch 14 remains open to allow liquid to be placed within the interior pocket 64 of the pouch 14. After the liquid and other product is placed in the interior pocket 64 of the pouch, the first opening 24 of the containing vessel 12 is closed with the cover 30 therefor.

With this embodiment, liquid contacts only the interior pocket 64 of the pouch, an interior of the spout 16, and an interior of the dispensing tube 18. Since the pouch 14, spout 16, and dispensing tube 18 are disposable, they are adapted to be removed from the containing vessel 12 after use and discarded. Only the containing vessel 12, with cover 30, and the dispensing valve 20 are permanent fixtures. As such, the system is adapted to allow for the installation of a new pouch, spout, and dispensing tube daily to maintain a completely sanitized system. Any bacteria from the liquid only contacts the interior of the disposable items and does not contaminate the permanent fixtures.

Figure 6B:
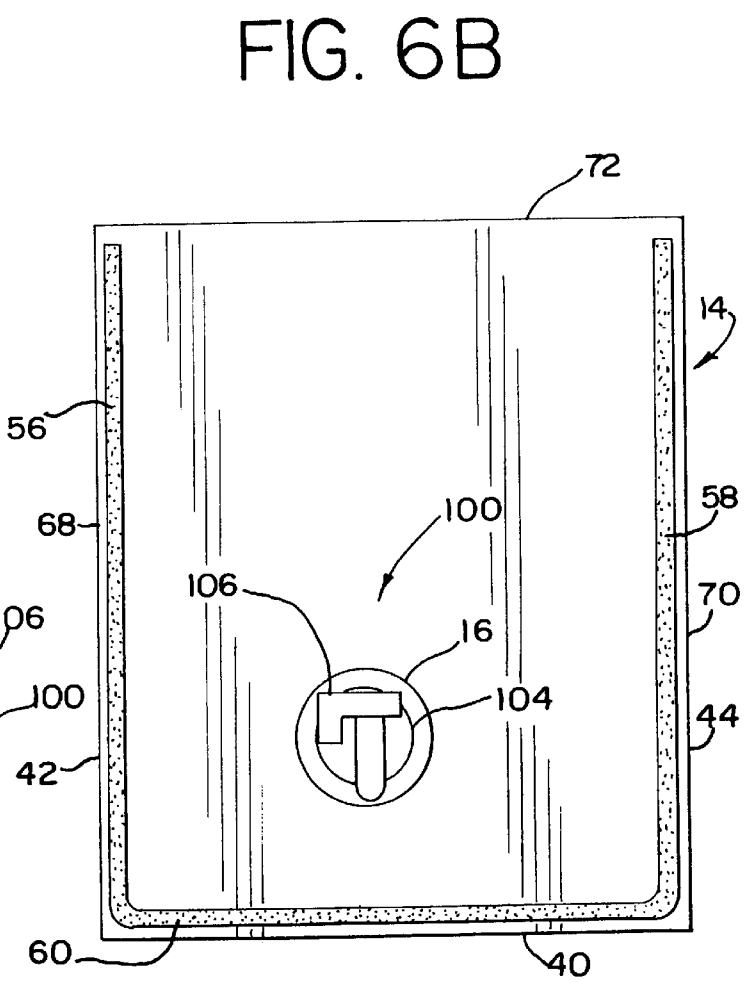
FIG. 6A is a side elevation view of another embodiment of a dispensing means of the present invention; and, FIG. 6B is a front elevation view of the dispensing means of FIG. 6A.
Figure 6A:
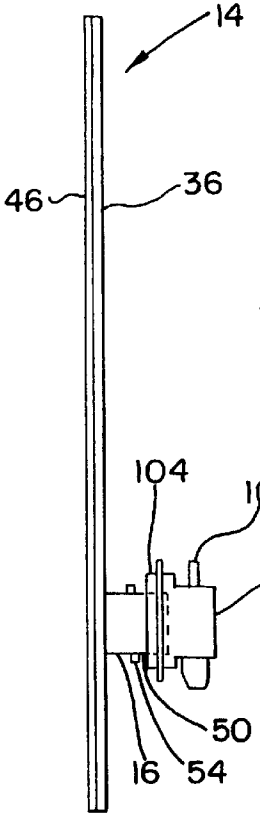

FIGS. 6A and 6B illustrate another embodiment of the dispenser 100 which is connected to the spout 16. (Like components of this embodiment will be described with the same reference numerals as the first embodiment.) The dispenser 100 comprises a dispensing valve having a fitment 104 thereon. The fitment 104 is dimensioned to fixedly attach the dispenser 100 to the cylindrical portion 50 of the spout 16 of the pouch 14 shown in FIGS. 3A and 3B. Like the previous embodiment, the fitment 104 snaps onto the ribs 54 of the spout. The dispensing valve portion of the dispenser 100 has a rotatable member 106 which, when manipulated, controls the rate of egress of liquid through the dispenser 100. Thus, unlike the first embodiment, the dispenser 100 and the dispensing valve of this embodiment are one component. Accordingly, when using this dispenser 100 as shown in FIGS. 6A and 6B, a separate dispensing valve 20 is not required. Thus, the system of the embodiment shown in FIGS. 6A, 6B (which works in conjunction with the containing vessel 108 illustrated in FIG. 5), generally comprises only four main components: a containing vessel 108, a pouch 14, a spout 16, and a dispensing valve 100. While this embodiment is generally used with new applications, it can also operate as a retrofit system for a standard dispensing container 12. To operate as such, however, the second opening 26 of the containing vessel 12 must be re-worked to allow the dispenser 100 to pass through.

Figure 5:
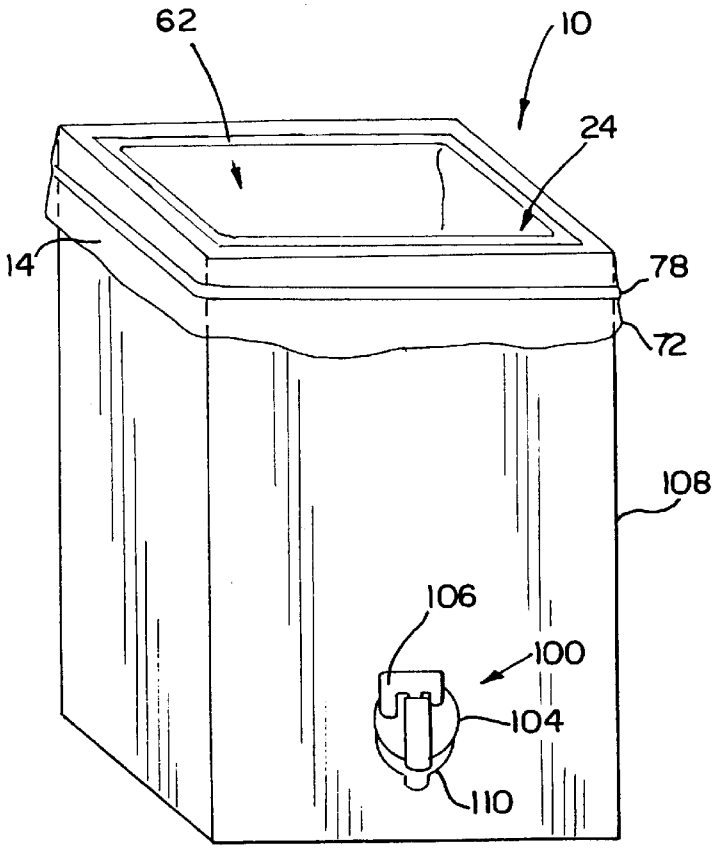
FIG. 5 is a perspective view of another embodiment of a beverage dispensing system of the present invention.

As shown in FIG. 5, the containing vessel 108 which works in conjunction with the dispensing valve 100 of FIGS. 6A and 6B has an irregular shaped second opening 110. This allows the dispensing valve 100 connected to the spout 16 to be extended directly through the second opening 110 in the containing vessel 108 to the outside thereof. Once the dispensing valve 100 is outside the containing vessel 108 it is removably secured to an outside of the containing vessel adjacent the second opening 110. The dispensing valve 100 is removably secured to the containing vessel 108 by sliding the dispensing valve 100 upward to snap into place in the second opening 110.

To set up the system illustrated in FIGS. 5, 6A, and 6B, the initial step is to attach the dispensing valve 100, via the fitment 104 thereof, to the spout 16. Next, the pouch 16 is inserted into the interior cavity 22 of the containing vessel 108. At the same time, the dispensing valve 100 is placed through the second opening 110 in the containing vessel 108 and is removably secured to the wall of the containing vessel 108 by a snap fit to a portion of the second opening 110. Finally, the first end 72 of the pouch 14 is located proximal the first opening 24 of the containing vessel 108 and is secured thereto similar to the previously described embodiment.

With this embodiment, liquid contacts only the interior pocket 64 of the pouch, an interior of the spout 16, and an interior of the dispensing valve 100. Since the pouch 14, spout 16, and dispensing valve 100 are disposable, they are adapted to be removed from the containing vessel 108 after use and discarded. Only the containing vessel 108 with its cover (not shown) is a permanent fixture. As such, the system is adapted to allow for the installation of a new pouch, spout, and dispensing valve daily to maintain a completely sanitized system. Any bacteria from the liquid only contacts the interior of the disposable items and does not contaminate the permanent fixtures.

The process of filling, containing and utilizing the dispensing system is the same for each embodiment. The process includes inserting different types of liquid and product into the interior pocket 64 of the pouch 14 in sequential steps. The exact sequence of the insertion steps, however, is not essential. In a preferred embodiment the system is utilized for dispensing brewed iced tea, however, other brewed and non-brewed liquids may properly be incorporated with this process and utilize this system. With this embodiment, cold water, brewed tea, and boiling water are each inserted into the interior pocket of the pouch. Ice is then inserted into the interior pocket of the pouch to complete the process.

A similar process of providing brewed iced tea for dispensing in this system incorporates brewing the tea directly within the interior pocket 64 of the pouch 14. In this process, the tea, preferably in bags, is first inserted into the interior pocket. Boiling water is then added to the tea in the interior pocket to brew the tea. Once the tea is properly brewed, additional water and ice are inserted into the interior pocket of the pouch to complete the brewed iced tea.

While the specific embodiments have been illustrated and described, numerous modifications come to mind without significantly departing from the spirit of the invention, and the scope of protection is only limited by the scope of the accompanying Claims.

We claim:

1. A system for dispensing a liquid beverage comprising:

a containing vessel having an interior cavity, a first opening, and a second opening;

a pouch dimensioned to fit through the first opening and within the interior cavity of the containing vessel, the pouch having a first opening adjacent a first end of the pouch, a second opening proximal a second end of the pouch, and an interior pocket, wherein the first end of the pouch is adapted to remain substantially adjacent the first opening of the containing vessel to allow liquid to be placed within the interior pocket of the pouch through the first opening of the vessel;

a spout connected to the second opening of the pouch;

a separate elongated dispensing tube removably connected to the spout; and, a dispensing valve at the second opening of the containing vessel, the dispensing valve having an aperture, and the dispensing tube being dimensioned to be inserted through the aperture in the dispensing valve, wherein the dispensing valve controls the egress of liquid from the interior pocket of the pouch and through the dispensing tube.

2. The system of claim 1, wherein the interior pocket extends from substantially the first end of the pouch to substantially the second end of the pouch.

3. The system of claim 1, wherein the pouch is made of a material that has a melt softening point greater than 175 degrees Fahrenheit.

4. The system of claim 3, wherein the pouch is made of a linear low density polyethylene.

5. The system of claim 1, wherein the pouch has opposing side seals extending from the first end of the pouch to the second end of the pouch, and a bottom seal extending a length of the second end of the pouch.

6. The system of claim 1, wherein the pouch, spout, and dispensing tube are adapted to be removed from the containing vessel after use, and the system is adapted to allow for installation of a new pouch, spout, and dispensing tube.

7. The system of claim 1, wherein the liquid contacts the interior cavity of the pouch, an interior of the spout, and an interior of the dispensing tube.

8. The system of claim 1, further comprising a means for removably connecting the first end of the pouch adjacent the first opening of the containing vessel.

9. The system of claim 8, wherein the means is an elastic band.

10. The system of claim 1, further comprising a cover dimensioned to fit over a top of the vessel at the first opening thereof.

11. A system for dispensing a liquid beverage comprising:

a containing vessel having an interior cavity a first opening and a second opening;

a pouch dimensioned to fit through the first opening and within the interior cavity of the containing vessel, the pouch having a first opening adjacent a first end of the pouch, a second opening proximal a second end of the pouch, and an interior pocket, wherein the first end of the pouch is adapted to remain substantially adjacent the first opening of the containing vessel to allow liquid to be placed within the interior pocket of the pouch through the first opening of the vessel;

a spout connected to the second opening of the pouch; and, a separate dispensing valve connected to the spout, wherein the dispensing valve controls the egress of liquid from the interior pocket of the pouch and through the spout and an interior of the dispensing valve, and wherein the dispensing valve, when connected to the spout, is dimensioned to extend through the second opening in the containing vessel and to be directly secured to the containing vessel adjacent the second opening thereof.

12. The system of claim 11, wherein the pouch, spout, and dispensing valve are adapted to be removed from the containing vessel after use, and the system is adapted to allow for installation of a new pouch, spout, and dispensing valve.

13. The system of claim 11, wherein the liquid contacts the interior cavity of the pouch, an interior of the spout, and an interior of the dispensing valve.

14. A process for containing and dispensing liquid beverage comprising the steps of:

providing a containing vessel, the containing vessel having a cavity, a first opening and a second opening;

providing a pouch having a first opening adjacent a first end of the pouch, a second opening proximal a second end of the pouch, an interior pocket extending from substantially the first end of the pouch to substantially the second end of the pouch, and a spout adjacent the second opening of the pouch;

providing a dispenser having a fitment at an end thereof;

connecting the fitment of the dispenser to the spout;

inserting the pouch into the cavity;

extending a portion of the dispenser through the second opening of the containing vessel;

locating the first end of the pouch proximal the first opening of the containing vessel such that the first opening of the pouch remains open to allow liquid to be placed within the interior pocket of the pouch;

providing ice water brewed tea, and boiling water;

inserting the water into the interior pocket of the pouch through the first opening thereof;

inserting the brewed tea into the interior pocket of the pouch through the first opening thereof;

inserting the boiling water into the interior pocket of the pouch through the first opening thereof; and, inserting the ice into the interior pocket of the pouch through the first opening thereof.

15. The process of claim 14, further comprising the steps of:

providing a cover for the containing vessel; and, covering the containing vessel with the cover.

16. The process of claim 14, further comprising the steps of:

providing a dispensing valve at the second opening of the containing vessel; and, extending the dispenser through the dispensing valve, wherein the dispenser has a dispensing tube connected to the fitment, and wherein the dispensing valve has an adjustable crimper to control the egress of liquid through the dispensing tube.

17. The process of claim 14, further comprising the step of:

removably securing the dispenser to the containing vessel adjacent the second opening thereof, the dispenser having a valve for controlling the egress of liquid from the interior pocket of the pouch.

18. A process for containing and dispensing liquid beverage comprising the steps of:

providing a containing vessel, the containing vessel having a cavity, a first opening and a second opening;

providing a pouch having a first opening adjacent a first end of the pouch, a second opening proximal a second end of the pouch, an interior pocket extending from substantially the first end of the pouch to substantially the second end of the pouch and a spout adjacent the second opening of the pouch;

providing a dispenser having a fitment at an end thereof;

connecting the fitment of the dispenser to the spout;

inserting the pouch into the cavity;

extending a portion of the dispenser through the second opening of the containing vessel;

locating the first end of the pouch proximal the first opening of the containing vessel such that the first opening of the pouch remains open to allow liquid to be placed within the interior pocket of the pouch;

providing tea, cold water, boiling water, and ice;

inserting the tea into the interior pocket of the pouch through the first opening thereof;

inserting the boiling water into the interior pocket of the pouch through the first opening thereof to brew the tea in the interior pocket of the pouch;

inserting the cold water into the interior pocket of the pouch through the first opening thereof; and, inserting the ice into the interior pocket of the pouch through the first opening thereof.

19. The process of claim 18, further comprising the steps of:

providing a cover for the containing vessel; and, covering the containing vessel with the cover.

20. The process of claim 18, further comprising the steps of:

providing a dispensing valve at the second opening of the containing vessel; and, extending the dispenser through the dispensing valve, wherein the dispenser has a dispensing tube connected to the fitment, and wherein the dispensing valve has an adjustable crimper to control the egress of liquid through the dispensing tube.

21. The process of claim 18, further comprising the step of:

removably securing the dispenser to the containing vessel adjacent the second opening thereof, the dispenser having a valve for controlling the egress of liquid from the interior pocket of the pouch.

* * * * *

UNITED STATES PATENT AND TRADEMARK OFFICE

CERTIFICATE OF CORRECTION

PATENT NO. : 6,116,467
DATED : September 12, 2000
INVENTOR(S) : Paul F. Petriekis and Michael Wilford

It is certified that error appears in the above-identified patent and that said Letters Patent is hereby corrected as shown below:

Column 9, Line 26, after "cavity" insert --,--

Column 9, Line 26/27, after "opening" and before "and" insert --,--

Column 10, Line 8, after "ice" insert --,--

Column 10, Line 8, after "water" and before "brewed" insert --,--

Column 10, Line 46, after "pouch" insert --,--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*